US007017196B2

(12) United States Patent
Sterling et al.

(10) Patent No.: US 7,017,196 B2
(45) Date of Patent: Mar. 28, 2006

(54) HAT DEVICE

(75) Inventors: W. Gregg Sterling, Olney, MD (US); W. Jason Rowe, Huntington, WV (US)

(73) Assignee: Off the Rim, LLC, Olney, MD (US)

( * ) Notice: Subject to any disclaimer, the term of this patent is extended or adjusted under 35 U.S.C. 154(b) by 30 days.

(21) Appl. No.: 10/620,578

(22) Filed: Jul. 17, 2003

(65) Prior Publication Data

US 2005/0010991 A1 Jan. 20, 2005

(51) Int. Cl.
*A42B 1/00* (2006.01)

(52) U.S. Cl. ..... 2/918; D2/868

(58) Field of Classification Search ..... 2/171, 2/174, 182, 195.1, 182.8; 40/329; D2/869
See application file for complete search history.

(56) References Cited

U.S. PATENT DOCUMENTS

| | | | | | |
|---|---|---|---|---|---|
| 2,696,007 | A | * | 12/1954 | Larkin et al. | 2/171 |
| 5,708,983 | A | * | 1/1998 | Cross et al. | 2/171 |
| D420,206 | S | * | 2/2000 | Lawson | D2/869 |
| D422,399 | S | * | 4/2000 | Flugger | D2/871 |
| D432,291 | S | * | 10/2000 | McIntyre | D2/869 |
| D482,847 | S | * | 12/2003 | Lee | D2/869 |
| D493,947 | S | * | 8/2004 | Carmody et al. | D2/869 |
| D502,588 | S | * | 3/2005 | Crews | D2/869 |
| 2004/0083535 | A1 | * | 5/2004 | Rugg | 2/209.11 |

* cited by examiner

*Primary Examiner*—Gary L. Welch
(74) *Attorney, Agent, or Firm*—William L. Klima; Klima Law Offices, P.L.L.C.

(57) ABSTRACT

A hat device configured to visually simulate a vehicle tire. The hat device is configured so that the visually simulated tire is worn transversely relative to a user's head.

17 Claims, 3 Drawing Sheets

HAT DEVICE

FIELD OF THE INVENTION

The present invention relates to a hat device. More specifically, the present invention relates to an amusement hat device configured to visually simulate a vehicle tire and/or wheel.

BACKGROUND OF THE INVENTION

In recent years, it has become popular for sports enthusiasts to wear hats configured to visually simulate a product or item associated with the team they desire to support. For example, it is widely known that fans for the GREEN BAY PACKERS, NATIONAL FOOTBALL LEAGUE (NFL) are known to wear hats configured to visually simulate a large wedge of cheese and are referred to as "Cheeseheads" when wearing these hats. These fans wear these particular hats to games in support of their teams.

Over the past twenty years, car racing, in particular NASCAR Racing has gained a tremendous number of fans and is now the most highly watched sport in the United States. The popularity of NASCAR Racing is encountered in all aspects of our lives, including significant coverage on television, cable and DIRECT TV, and has become immortalized by such films as Tom Cruise's DAYS OF THUNDER. Like football, fans of racing in particular NASCAR Racing may be interested in showing support for their sport by wearing hats that symbolize or suggest one or more aspects of the sport. Thus, this is the introduction of a unique tire hat device.

SUMMARY OF THE INVENTION

A first object of the present invention is to provide an improved hat device.

A second object of the present invention is to provide a hat device configured to visually simulate a vehicle tire.

A third object of the present invention is to provide a hat device configured to visually simulate a vehicle tire and wheel.

A fourth object of the present invention is to provide a hat device configured to visually simulate a vehicle tire, including a tire tread portion and at least one sidewall portion.

A fifth object of the present invention is to provide a hat device configured to visually simulate a vehicle tire, and made of a soft resilient material such as foam, foam rubber, sponge or other similar product.

A sixth object of the present invention is to provide a hat device configured to simulate a vehicle tire, including an inner hat portion made of a resilient material and an outer fabric cover or layer provided over the inner hat portion.

A seventh object of the present invention is to provide a hat device configured to simulate a vehicle tire, including an inner hat portion and a removable outer cover or layer of fabric material.

The present invention is directed to a hat device, in particular to an amusement hat device.

The hat device according to the present invention is configured to simulate a vehicle tire. For example, the vehicle tire can be an automobile tire, truck tire, race car tire, NASCAR tire, Indy car tire, drag car tire, motorcycle tire, trailer tire, aircraft tire, or any other suitable vehicle type tire desired. For purposes of the present invention, it is even possible that an actual vehicle tire specifically designed or configured to meet or include the features or specifications of the hat device according to the present invention may be provided.

A preferred embodiment of a hat device according to the present invention can also be configured to be used as a seat cushion, for example, at a racing event.

The hat device according to the present invention can be made from a variety of different types of materials, and by various methods.

For example, the hat device can be made of one or more soft pliable or resilient material, can be made of some rigid-or semi-rigid material, or a combination thereof. A preferred embodiment of the hat device according to the present invention is made from a soft resilient synthetic foam or sponge material covered by a fabric material such as a natural fiber, natural fiber blend, cotton, cotton blend, synthetic fiber, polyester, polyester blend or other suitable fabric material. The soft pliable foam or sponge material, for example, can be a polyurethane foam. Other embodiments of the hat device according to the present invention can be made of less expensive materials such as paper, paper stock, newspaper, paper mache, cardboard, plastic, plastic sheeting, vacuum form plastic, plastic resin, synthetic resin, injected molded plastic, molding material, molding synthetic clay, molding resin, fiber glass, composite materials, plastic composite materials, KEVLAR, carbon graphite, or other suitable materials.

The hat device according to the present invention can be made by one or more methods, including cutting, molding, vacuum forming, milling, molding, injection molding, weaving, or other suitable technique. For making a preferred embodiment of the hat device according to the present invention, a synthetic foam block is cut by a hot wire technique. For example, a doughnut-shaped inner hat portion is formed from the soft resilient foam material by using a hot wire to cut the outer cylindrical-shaped surface and inner cylindrical-shaped surface. Then an outer cover is made from a flat sheet or web of cotton blend fabric material cut and sewn so as to snuggly fit around the inner foam core.

A further embodiment of the hat device according to the present invention can be an inflatable device. For example, a pair of plastic vinyl sheet material is cut and heat welded together to provide a hat device according to the present invention when inflated with air.

The hat device according to the present invention is configured to be worn transversely on the user's head. Specifically, the hat device is configured to be worn transverse relative to a vertical centerline through a user's head. In this manner, an upper portion of the user's head fits within a recess provided on a lower side of the tire-shaped hat device. In a preferred embodiment in which the hat device according to the present invention is provided with a through hole to simulate the through hole of a vehicle tire, an upper portion of the user's head fits within a lower portion of the through hole of the simulated vehicle tire hat device. The size and shape of the through hole can be varied from circular to oval so that the hat device snuggly fits on an upper portion of the user's head. When a soft resilient material such as synthetic foam or sponge is utilized as the inner hat portion of the device, the resilient nature of the material tends to snuggly grip the user's head when properly fit.

The hat device according to the present invention is worn mainly by humans, however with some modifications, can potentially be worn by animals when configured to fit the particular head shape and size of an animal and provided with the proper accommodations for a particular animal (e.g. holes to accommodate ears of a dog, cat, or horse).

DETAILED DESCRIPTION OF PREFERRED EMBODIMENTS

A hat device 10 according to the present invention is shown in FIGS. 1–5.

The hat device 10 includes a tread portion 12, a pair of side wall portions 14*a* and 14*b*, a pair of tire bead portions 16*a* and 16*b*, indicia 18, and a through hole 20. The indicia 18, for example, can be a trademark such as GOODYEAR owned by Goodyear Tire and Rubber Company.

Figure 1:
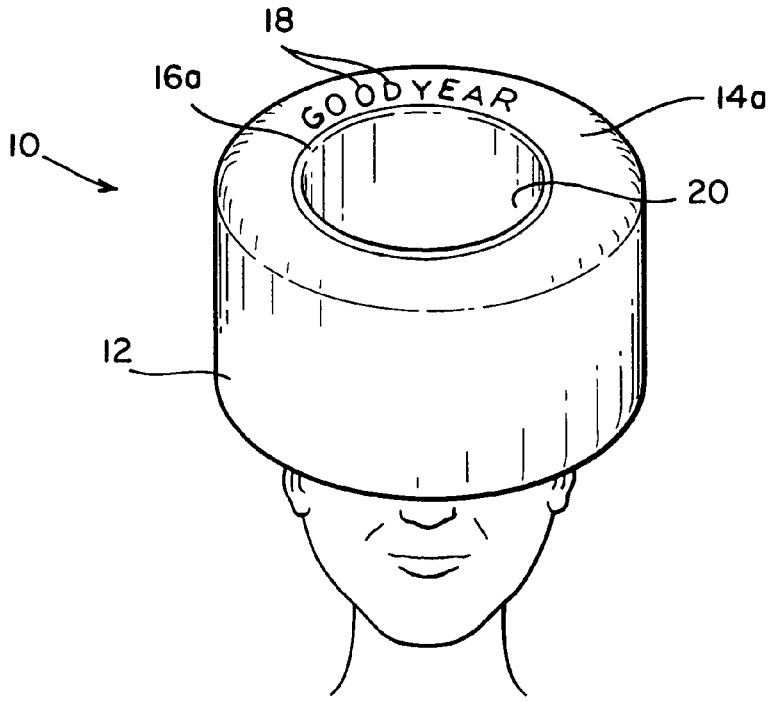
FIG. 1 is a prospective view of a tire device according to the present invention being shown worn on a person's head.
Figure 2:
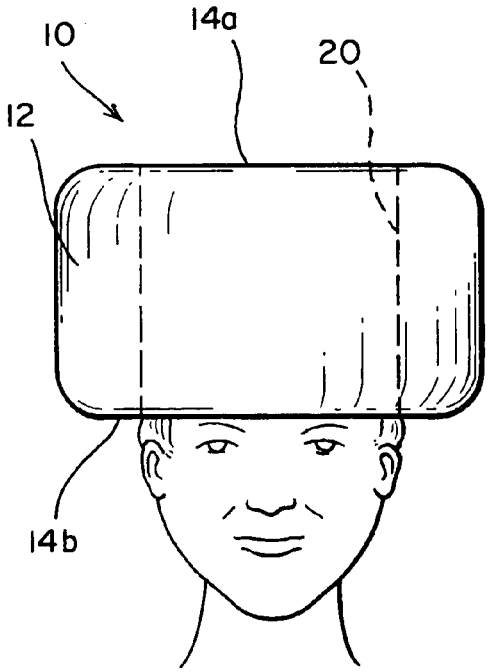
FIG. 2 is a side elevational view of the tire device shown in FIG. 1.
Figure 3:
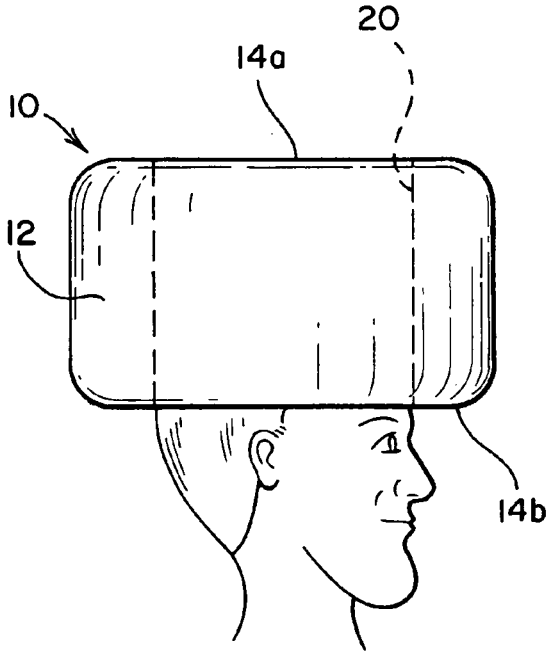
FIG. 3 is another side elevational of the tire device shown in FIG. 1.
Figure 4:
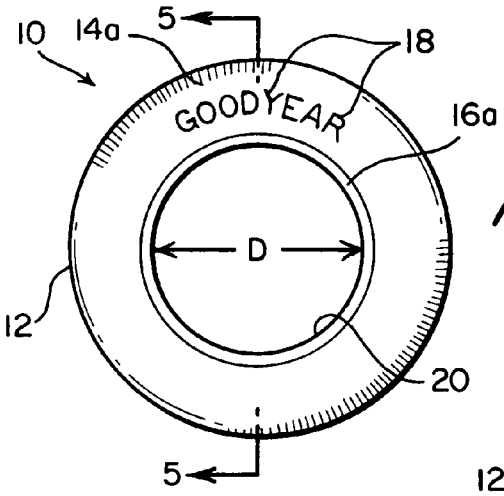
FIG. 4 is a top plainer view of the side of the hat device according to the present invention shown in FIG. 1.

The hat device 10 shown in FIGS. 1–5 is configured to visually simulate a NASCAR type vehicle tire. Specifically, the tread portion 12 is smooth and not provided with any tread pattern (i.e. a slick) and the sidewall portion 14*a* and 14*b* are substantially uncharacterized except for the bead portion 16*a* and 16*b* indicia 18. (i.e. plain style or design). As shown in FIG. 4, the through hole 20 is shaped and sized to snuggly fit a person's head. For example, the through hole 20 can be a cylindrical-shaped through hole having a diameter D. In constructing a hat device 10 according to the present invention, if soft resilient materials are utilized in the construction thereof, the diameter D can be slightly undersized to allow expansion of the hat device 10 when fitted on a person's head. However, when rigid or substantially rigid materials are utilized in the construction of the hat device, the diameter D must be selected to be properly sized to fit the person's head. Alternatively, the through hole 20 can have other shapes such as oval-shaped or custom shaped while still visually simulating the through hole of a vehicle tire. Further the through hole 20 can be expanded outwardly within the center portion of the hat device 10 to simulate the inner surface profile and cavity of a vehicle tire to more closely visually simulate a real vehicle tire. (See FIG. 6).

Figure 5:
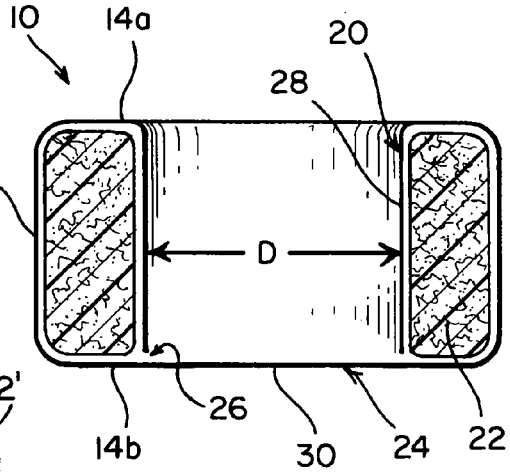
FIG. 5 is a transversed cross-sectional view of the hat device as indicated in FIG. 4.

The hat device 10 is constructed of an inner hat portion 22 made, for example, of a soft resilient foam or sponge material cut or molded to have a cylindrical-shape ring as indicated in FIGS. 4 and 5. An outer hat portion or cover 24, for example, made of a cotton blend fabric material is cut and sewn to provide a cover around the entire inner hat portion 22 (i.e. envelope). Specifically, the outer hat portion or cover 24 is configured as a toric-shaped article that is designed or configured to fit over and around the inner hat portion 22 by providing a seam 26 between an inner cylindrical-shaped portion 28 of the outer hat portion 24 and a bottom portion 30 of the cover 24. For example, the seam can be an open seam having no fastener, or alternatively, a fastener such as a zipper, slide fastener and/or mechanical fastener can be provided to substantially close or seal the seam. The cover 24 is preferable removable and washable, and thus the provision of the seam 26, (for example to allow cleaning or replacement of the cover 24). Alternatively, the seam 26 can be totally eliminated by sewing the seam 26 shut, preventing the later removal of the cover 24 without damage or destruction thereof making a more or less permanent cover.

The inner hat portion 22 can be made from a soft resilient synthetic foam or sponge material that is cut (hot wired) or molded to have the particular configuration shown in FIGS. 1–5. Alternatively, the inner hat portion 28 can be made of a rigid or semi-rigid foam or sponge material, natural sponge, stuffing, foam peanuts, STYROFOAM, paper, paper mache, plastic, injection molded plastic, wood, cardboard, or other suitable material or combination of materials that can be cut or formed to have the particular configuration shown in the drawings.

Figure 6:
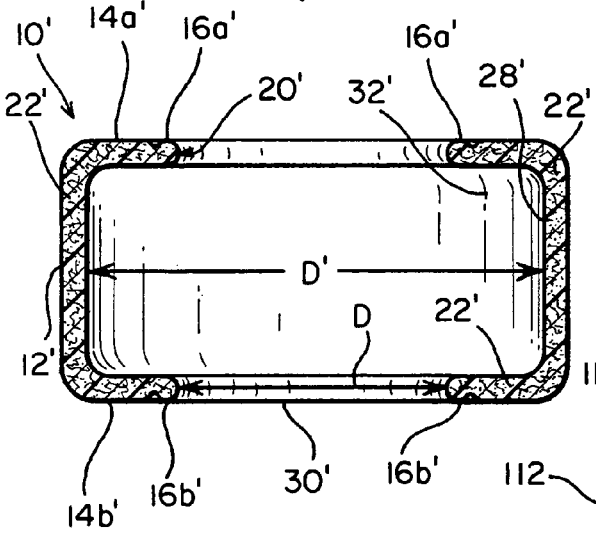
FIG. 6 is a transversed cross-sectional view of another embodiment of the hat device according to the present invention.

As shown in FIG. 6, an alternative embodiment of the hat device 10' is shown having an inner annular space or cavity 32' to more closely visually simulate a vehicle tire. Further, this embodiment reduces the amount of material utilized in constructing the inner hat portion 28'. Alternatively, the inner hat portion 28 shown in FIG. 5 can be modified to be hollow, configured to have hollow cells or cavities, or other techniques can be employed to reduce the amount of material utilized in the construction thereof.

In the embodiment shown in FIG. 6, the cover 28' is glued, adhered, welded or otherwise placed in direct contact with the inner hat portion 22'. In this manner, the cover 28' is able to follow the inner contour of the through hole 20' of the hat device 10, to provide the inner annular space or cavity 32' to more visually simulate a vehicle tire versus the embodiment shown in FIGS. 1–5.

Figure 7:
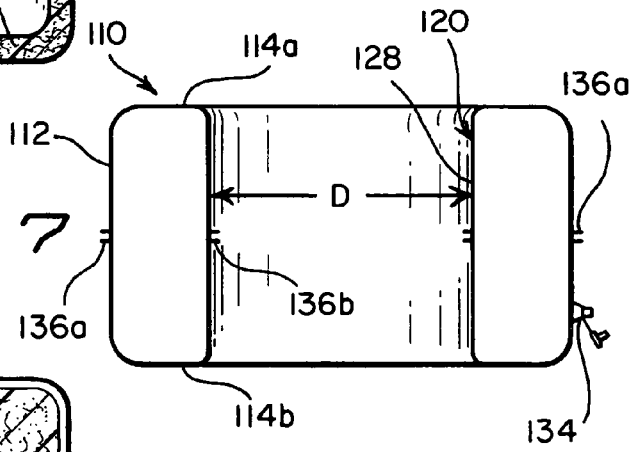
FIG. 7 is a transversed cross-sectional view of a further embodiment of the hat device according to the present invention.

A further embodiment of the hat device 110 is shown in FIG. 7.

The hat device 110 is an inflatable device provided with an air inflation nozzle or valve 134 to allow a person to inflate the hat device 110 with his or her mouth, or alternatively with a pump (e.g. hand pump). The walls of the hat device 110 can be made, for example, from vinyl sheet material and heat welded together at seams 136*a* and 136*b* as shown. In this embodiment, an upper sheet portion member is welded to a lower sheet portion.

Figure 8:
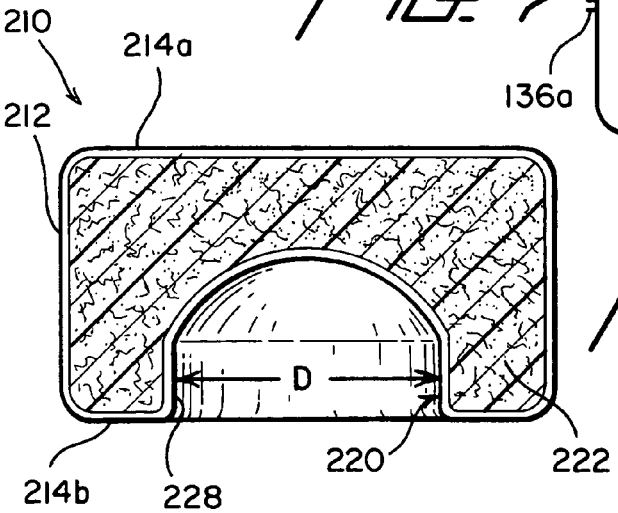
FIG. 8 is a transversed cross-sectional view of an even further embodiment of the hat device according to the present invention.

An even further embodiment of the hat device 210 is shown in FIG. 8.

The hat device 210 is substantially the same as the embodiment shown in FIGS. 1–5, except that the through hole 20 has been replaced with a recess 238 sized and shaped to accommodate an upper portion of a person's head.

The visual features of the tire such as the tread portion, sidewall portions, bead portions, and indicia is preferably visually simulated by printing on the outer cover or layer of the hat device. Preferable the outer cover is screen printed in color as a flat sheet or web of material prior to converting by cutting and sewing into the configuration of the cover to be placed over the inner hat portion. Alternatively, the vehicle tire can be simulated by other techniques such as painting, spray painting, coating, coloring, air brushing, stenciling, labels or other suitable techniques to visually simulate aspects or features of a real vehicle tire, and can be applied to the hat device during construction thereof. Further, the inner hat portion and/or the outer hat portion or cover can be textured to simulate in three (3) dimensions tread patterns, raised lettering, bead portions, indicia and other raised and/or contoured features of a vehicle tire to simulate the look and appearance thereof.

Figure 9:
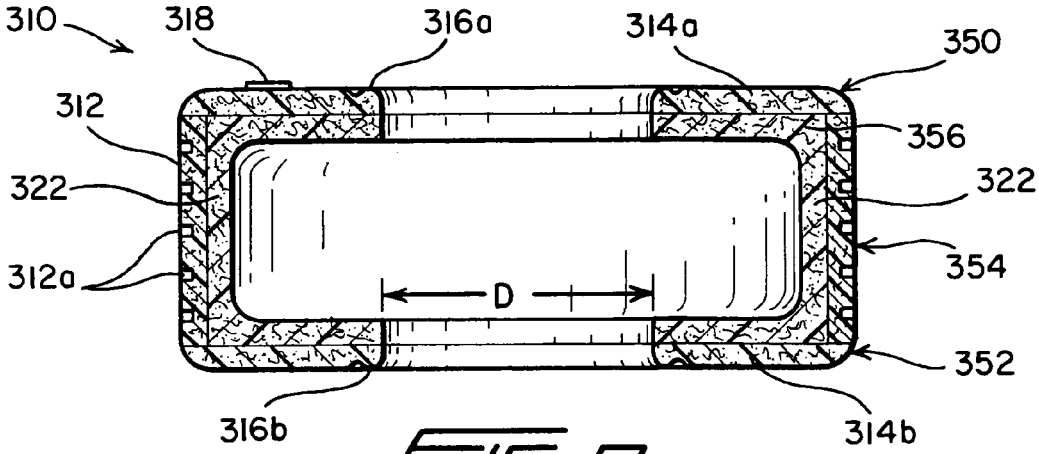
FIG. 9 is a transversed cross-sectional view of an even further embodiment of the hat device according to the present invention.

An even further embodiment of the hat device 310 according to the present invention is shown in FIG. 9.

The hat device 310 is configured to visually simulate all aspects of a vehicle tire. Specifically, the hat device 310 is constructed of an upper layer 350, a lower layer 352, a side layer 354 and a core 356 as shown. These are separate layers and/or components. Preferably, these layers or components are molded or cut from synthetic foam materials and glued or adhered together, or otherwise bonded together as indicated. Preferably the upper layer 350 and lower layer 352 are molded or contoured in three (3) dimensions to visually simulate a raised indicia 318 and contoured bead portions 316*a* and 316*b*. Further the side layer 354 is preferably cut or contoured to visually simulate a three dimensional tread pattern 312*a*. In this manner, the three (3) dimensional characteristics or features of a real vehicle tire are visually simulated in the hat device according to the present invention.

Figure 10:
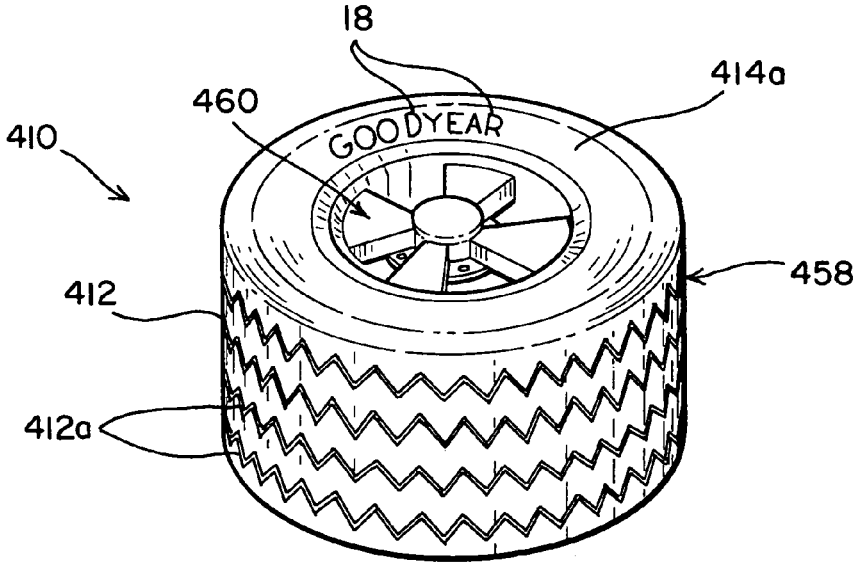
FIG. 10 is a prospective view of another even further embodiment of the hat device according to the present invention.
Figure 11:
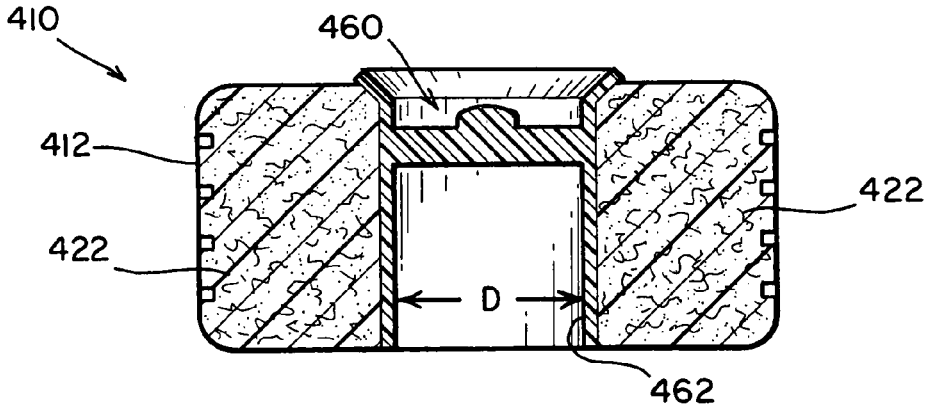
FIG. 11 is a transversed cross-sectional view of the hat device shown in FIG. 10.

Another even further embodiment of the hat device 410 according to the present invention shown in FIGS. 10 and 11.

The hat device 410 is provided with a tire portion 458 mounted on a wheel portion 460. For example, the wheel portion can be a standard wheel, steel wheel, mag wheel, or other style configured to visually simulate a real vehicle wheel. The wheel 460 is provided with a recess 462 having a diameter D configured to fit an upper portion of a person's head. The tire portion 458 and wheel portion 460 can be made as one (1) piece, or can be made as separate components.

We claim:

1. An amusement hat device, comprising:

a tire-shaped hat portion configured to visually simulate at least a portion of a vehicle tire, said hat portion having a substantially flat upper surface and provided with a recess provided on at least one side thereof, said recess configured to receive an upper portion of a user's head to allow said hat device to be worn so that said vehicle tire visually simulated is oriented substantially transversely relative to a user's head and so that said upper surface of said hat portion is located above a top of the user's head, said hat portion is made with an inner hat portion made of resilient material and provided with an outer fabric layer covering said inner hat portion, and said fabric layer is printed to visually simulate a vehicle tire.

2. A device according to claim 1, wherein said hat portion is configured to visually simulate a tread portion and at least one sidewall portion of a real vehicle tire.

3. A device according to claim 1, wherein said hat portion is configured to visually simulate a tread portion, sidewall portions, and through hole of a real vehicle tire.

4. A device according to claim 3, wherein said through hole is configured to receive an upper portion of a user's head.

5. A device according to claim 3, wherein said through hole is sized and shaped to fit the upper portion of the user's head.

6. A device according to claim 5, wherein said through hole is sized and shaped to fit the upper portion of a person's head.

7. A device according to claim 1, wherein said vehicle tire is visually simulated by treating said hat portion by at least one method selected from the group consisting of printing, screen printing, painting, air brushing, coloring, shading, and dying.

8. A device according to claim 7, wherein said vehicle tire is visually simulated by making said hat portion by at least one method selected from the group consisting of cutting, molding, contouring, shaping, forming and tailoring.

9. A device according to claim 1, wherein said vehicle tire is visually simulated by making said hat portion by at least one method selected from the group consisting of molding, contouring, shaping, forming and tailoring.

10. A device according to claim 1, wherein said outer fabric layer is configured to be removable from said inner hat portion.

11. A device according to claim 10, wherein said outer fabric layer is a toric-shaped cover having a seam configured to allow said inner hat portion to be inserted into or removed there from.

12. A device according to claim 11, wherein said seam is an annular-shaped seam located within an annulus portion of said hat portion.

13. A device according to claim 11, wherein said seam is an open overlapping type seam.

14. A device according to 11, wherein said seam is provided with a resealable closure provided by at least one selected from the group consisting of zipper, slide closure, button, hook and loop type fastener and mechanical fastener.

15. A device according to claim 1, wherein said hat portion is configured to visually simulate at least one selected from the group consisting of tire appliqué, pin striping, tire manufacturer name, tire brand name, tire model, raised sidewall, two-dimensional tread pattern, three-dimensional tread pattern, tire decals, tire bead, scuff marks, wear marks, wear pattern, slick, stock car style tire, formula one racing car style tire, drag car style tire, racing car style tire, wheel, and mag wheel.

16. A device according to claim 1, wherein said hat portion is configured to visually simulate a vehicle tire mounted on a wheel on at least one side of said simulate vehicle tire.

17. A device according to claim 1, wherein said hat portion includes a tire portion mounted on a separate wheel portion.

* * * * *